US012203728B2

(12) United States Patent
Lindsay et al.

(10) Patent No.: US 12,203,728 B2
(45) Date of Patent: Jan. 21, 2025

(54) WEAPON ACCESSORY MOUNT

(71) Applicant: AOB Products Company, Columbia, MO (US)

(72) Inventors: Michael Lindsay, Columbia, MO (US); James Tayon, Moberly, MO (US); Michael Cottrell, Ashland, MO (US); Justin Burke, Columbia, MO (US); Paul Coryell, Columbia, MO (US); Jarrod Grove, Columbia, MO (US); Curtis Smith, Columbia, MO (US)

(73) Assignee: AOB Products Company, Columbia, MO (US)

( * ) Notice: Subject to any disclaimer, the term of this patent is extended or adjusted under 35 U.S.C. 154(b) by 0 days.

(21) Appl. No.: 17/237,871

(22) Filed: Apr. 22, 2021

(65) Prior Publication Data

US 2021/0333068 A1 Oct. 28, 2021

Related U.S. Application Data

(60) Provisional application No. 63/014,027, filed on Apr. 22, 2020.

(51) Int. Cl.
*F41G 11/00* (2006.01)

(52) U.S. Cl.
CPC ..... *F41G 11/003* (2013.01)

(58) Field of Classification Search
CPC ..... F41G 11/003
See application file for complete search history.

(56) References Cited

U.S. PATENT DOCUMENTS 2,548,031 A * 4/1951 Leupold ..... F16B 2/08 403/188
3,045,351 A * 7/1962 Dayton ..... F41G 11/007 42/126
3,559,940 A * 2/1971 Kruzell ..... F41G 11/001 248/223.41
3,579,840 A 5/1971 Heinzel
3,750,318 A * 8/1973 Burris ..... F41G 11/003 42/127
4,688,345 A 8/1987 Kilgour
4,697,226 A 9/1987 Verdin
5,033,219 A 7/1991 Johnson et al.
5,179,235 A 1/1993 Toole
(Continued)

OTHER PUBLICATIONS

2001 Surefire WeaponLight Price List Catalog, Jan. 15, 2001, 13 pages.

(Continued)

*Primary Examiner* — Michelle Clement
(74) *Attorney, Agent, or Firm* — Stinson LLP

(57) ABSTRACT

Weapon accessory mount assembly, components thereof, and associated methods. A weapon accessory mount assembly mounts on first and second rails having respective first and second slots of different sizes. The assembly includes an accessory mount for attaching to an accessory and a rail mount for attaching to the first and second rails. The assembly also includes a rail slot key having a first key portion to be inserted into the first slot and a second key portion to be inserted into the second slot to inhibit longitudinal movement of the assembly along the respective first and second rails when mounted thereon.

36 Claims, 7 Drawing Sheets

(56) References Cited

U.S. PATENT DOCUMENTS 5,194,007 A 3/1993 Marshall et al.
5,237,773 A 8/1993 Claridge
5,400,540 A 3/1995 Solinsky et al.
5,428,915 A * 7/1995 King ..... F41G 11/003 42/126
5,430,967 A 7/1995 Woodman, III et al.
5,435,091 A 7/1995 Toole et al.
5,560,703 A 10/1996 Capps. , III
5,581,898 A 12/1996 Thummel
5,584,137 A 12/1996 Teetzel
5,590,486 A 1/1997 Moore
5,618,099 A 4/1997 Brubacher
5,628,555 A 5/1997 Sharrah et al.
5,669,173 A * 9/1997 Rodney, Jr. ..... F41G 11/003 42/127
5,685,105 A 11/1997 Teetzel
5,706,600 A 1/1998 Toole et al.
5,758,448 A 6/1998 Thummel
D398,410 S 9/1998 Fell et al.
5,913,669 A 6/1999 Hansen et al.
6,023,875 A 2/2000 Fell et al.
6,185,854 B1 2/2001 Solinsky et al.
6,230,431 B1 5/2001 Bear
6,276,088 B1 8/2001 Matthews et al.
6,363,648 B1 4/2002 Kranich et al.
6,378,237 B1 4/2002 Matthews et al.
6,438,888 B1 8/2002 Lin et al.
6,513,251 B2 2/2003 Huang et al.
6,526,688 B1 3/2003 Danielson et al.
6,571,503 B2 6/2003 Thorpe
6,574,901 B1 6/2003 Solinsky et al.
6,578,311 B2 6/2003 Danielson et al.
6,598,333 B1 * 7/2003 Randazzo ..... F41G 11/003 42/127
6,606,813 B1 8/2003 Squire et al.
6,609,810 B2 8/2003 Kim
6,671,991 B1 1/2004 Danielson
6,698,127 B2 3/2004 Weber
6,705,038 B2 3/2004 Davenport et al.
6,722,074 B1 4/2004 Farrell
6,732,987 B2 * 5/2004 Wooten ..... F41G 11/002 362/113
6,874,269 B2 4/2005 Chen et al.
D505,177 S 5/2005 Fell et al.
6,931,778 B1 8/2005 Nelson et al.
6,994,449 B2 2/2006 Kim
7,117,624 B2 10/2006 Kim
7,134,234 B1 11/2006 Makarounis
D536,116 S 1/2007 Sharrah
7,188,978 B2 3/2007 Sharrah et al.
7,199,315 B1 4/2007 Sharrah et al.
7,199,351 B2 4/2007 Toma
D543,446 S 5/2007 DiNenna
D548,385 S 8/2007 Sharrah et al.
7,260,910 B2 8/2007 Danielson
7,260,912 B2 8/2007 Liu
7,264,369 B1 9/2007 Howe
7,273,292 B2 9/2007 Kim
7,310,903 B2 12/2007 Kim
7,332,682 B2 2/2008 Kim
D567,894 S 4/2008 Sterling et al.
7,360,333 B2 4/2008 Kim
D568,508 S 5/2008 Howe et al.
7,325,352 B2 5/2008 Matthews et al.
D578,599 S 10/2008 Cheng
7,438,430 B2 10/2008 Kim
7,441,918 B2 10/2008 Kim
7,444,776 B2 * 11/2008 Adams ..... F41G 11/001 42/127
D585,516 S 1/2009 Smith
7,472,830 B2 1/2009 Danielson
7,493,722 B2 2/2009 Howe et al.
7,523,583 B2 4/2009 Cheng
7,543,405 B1 * 6/2009 Ivey ..... F41G 11/003 42/125
7,591,098 B2 9/2009 Matthews et al.
D603,478 S 11/2009 Hughes
7,614,760 B2 11/2009 Sharrah et al.
D612,970 S 3/2010 Sharrah et al.
7,674,003 B2 3/2010 Sharrah et al.
7,685,759 B2 3/2010 Teetzel
D616,957 S 6/2010 Rievley et al.
7,731,380 B2 6/2010 Wu
7,735,255 B1 6/2010 Kincaid et al.
7,736,013 B2 6/2010 Griffin
7,743,547 B2 6/2010 Houde-Walter
7,784,963 B2 8/2010 Galli et al.
7,805,876 B1 10/2010 Danielson et al.
7,819,547 B1 10/2010 Teetzel et al.
D628,323 S 11/2010 Matthews et al.
7,896,518 B2 3/2011 Holmes et al.
7,913,441 B1 3/2011 Reed
D636,049 S 4/2011 Hughes et al.
D636,837 S 4/2011 Hughes et al.
7,941,960 B2 5/2011 Matthews et al.
7,954,971 B1 6/2011 Kincaid et al.
8,028,461 B2 10/2011 NuDyke
8,052,297 B2 11/2011 Gross et al.
8,117,782 B2 2/2012 Gross et al.
8,132,355 B1 3/2012 Kincaid et al.
8,220,946 B1 7/2012 Teetzel
8,226,267 B2 7/2012 Sharrah et al.
8,256,154 B2 9/2012 Danielson et al.
D669,552 S 10/2012 Essig et al.
D669,553 S 10/2012 Hughes et al.
D669,957 S 10/2012 Hughes et al.
D669,958 S 10/2012 Essig et al.
D669,959 S 10/2012 Johnston et al.
8,276,307 B2 10/2012 Deros
8,287,157 B2 10/2012 Sharrah et al.
D672,005 S 12/2012 Hedeen et al.
8,322,066 B2 12/2012 Westra
D673,709 S 1/2013 Sharrah
D674,525 S 1/2013 Sharrah et al.
D674,861 S 1/2013 Johnston et al.
D674,862 S 1/2013 Johnston et al.
8,353,125 B2 * 1/2013 Riley ..... F41G 11/003 248/315
8,371,729 B2 2/2013 Sharrah et al.
8,397,421 B2 3/2013 Ding et al.
8,453,369 B1 6/2013 Kincaid et al.
D687,120 S 7/2013 Hughes et al.
8,499,484 B2 8/2013 Schneider et al.
8,510,979 B1 8/2013 Mortimer
D689,162 S 9/2013 Hilbourne et al.
D692,518 S 10/2013 Anderson et al.
D693,898 S 11/2013 Essig et al.
8,578,647 B2 11/2013 Storch et al.
8,584,392 B1 11/2013 Young
D694,847 S 12/2013 Anderson et al.
D694,848 S 12/2013 Anderson et al.
D696,376 S 12/2013 Anderson et al.
8,607,492 B2 12/2013 Hartley et al.
8,662,701 B2 3/2014 Sharrah et al.
8,683,731 B2 4/2014 Kowalczyk et al.
8,683,732 B2 4/2014 Joplin
8,683,733 B2 4/2014 Gross et al.
8,701,331 B2 4/2014 Schneider et al.
D704,297 S 5/2014 Cheng
8,727,556 B2 5/2014 Swan
8,727,561 B2 5/2014 Sharrah et al.
8,727,565 B2 5/2014 Domagala et al.
D709,158 S 7/2014 Wells
D709,585 S 7/2014 Klecker et al.
D709,981 S 7/2014 Johnston et al.
8,779,583 B2 7/2014 Pressel et al.
8,779,683 B2 7/2014 Snyder et al.
8,783,908 B2 7/2014 Gross et al.
D712,001 S 8/2014 Wells
8,813,412 B2 8/2014 Rorick
8,820,690 B2 9/2014 Weber

(56) References Cited

U.S. PATENT DOCUMENTS 8,857,097 B2 * 10/2014 Rorick ..... F41C 27/00 42/114
8,904,698 B2 12/2014 Riley et al.
8,915,009 B2 12/2014 Caulk et al.
8,960,942 B2 2/2015 Galli et al.
8,973,296 B1 3/2015 Kocmich, IV
D729,339 S 5/2015 Chavez et al.
D732,134 S 6/2015 Wells
9,091,508 B2 7/2015 Prieto
D738,455 S 9/2015 Homem de Mello Anderson et al.
D738,456 S 9/2015 Hughes
D738,457 S 9/2015 Johnston
D738,987 S 9/2015 Hughes
9,134,094 B2 9/2015 Hilbourne et al.
D740,388 S 10/2015 Klecker et al.
D742,991 S 11/2015 Klecker et al.
D749,689 S 2/2016 Cheng et al.
9,303,955 B2 * 4/2016 Jeung ..... F41G 1/30
9,322,617 B2 4/2016 Hartley et al.
D755,340 S 5/2016 Essig
D755,341 S 5/2016 Hartley
9,328,994 B2 5/2016 Hovsepian
9,377,271 B2 6/2016 Kowalczyk, Jr. et al.
D763,398 S 8/2016 Anderson
D763,399 S 8/2016 Anderson
D763,400 S 8/2016 Johnston
9,404,711 B1 8/2016 Hartley et al.
9,435,522 B2 * 9/2016 Galli ..... F21V 23/003
9,453,707 B2 9/2016 Williams et al.
9,488,439 B2 * 11/2016 Galli ..... F21V 23/0414
9,506,721 B2 11/2016 Cheng et al.
D777,289 S * 1/2017 Cheng ..... D22/109
9,551,550 B2 1/2017 Wells
9,658,031 B1 5/2017 Hedeen et al.
D792,544 S 7/2017 Hartley
9,772,161 B1 9/2017 Cheng
9,772,163 B2 9/2017 Sharrah et al.
9,810,411 B2 11/2017 Galli et al.
9,841,258 B1 * 12/2017 Galli ..... F41G 11/003
9,891,023 B2 2/2018 Compton et al.
10,001,342 B2 6/2018 Sharrah et al.
10,001,344 B1 6/2018 Alford et al.
10,024,632 B1 7/2018 Oglesby
10,041,765 B2 * 8/2018 McMakin ..... F41G 1/38
10,048,040 B1 * 8/2018 Ratliff ..... F41G 11/003
10,107,592 B1 10/2018 Huang et al.
10,344,959 B2 7/2019 Worman et al.
10,352,657 B2 7/2019 Galli et al.
10,365,069 B1 * 7/2019 Tayon ..... F41G 11/003
10,557,688 B2 2/2020 Batenhorst et al.
10,612,761 B1 4/2020 Worman et al.
10,619,977 B2 4/2020 Silvennoinen
10,942,009 B2 * 3/2021 Galli ..... F41G 1/35
11,105,586 B2 * 8/2021 Tayon ..... F41G 11/003
11,385,027 B2 * 7/2022 Galli ..... F41G 11/003
2002/0100202 A1 8/2002 Lin et al.
2002/0100204 A1 8/2002 Kim
2003/0101632 A1 6/2003 Davenport et al.
2003/0202345 A1 10/2003 Kim
2004/0148842 A1 8/2004 Aalto et al.
2004/0216352 A1 * 11/2004 Wooten ..... F41G 1/35 42/127
2005/0243542 A1 11/2005 Kim
2005/0246937 A1 11/2005 Kim
2005/0257415 A1 11/2005 Solinsky et al.
2006/0196099 A1 9/2006 Matthews et al.
2006/0242882 A1 11/2006 Liu
2007/0006512 A1 1/2007 Williams et al.
2007/0068058 A1 3/2007 Remo
2007/0068059 A1 3/2007 Kim
2007/0074444 A1 4/2007 Kim
2007/0113462 A1 5/2007 Ho
2007/0147042 A1 6/2007 Sharrah et al.
2007/0193103 A1 8/2007 Cheng
2007/0227056 A1 10/2007 Howe et al.
2007/0253189 A1 11/2007 Kim
2007/0266611 A1 * 11/2007 Stover ..... F41G 11/004 42/124
2007/0277422 A1 12/2007 Ding
2008/0022576 A1 * 1/2008 Epling ..... F41G 1/38 42/124
2008/0040965 A1 2/2008 Solinsky et al.
2008/0094823 A1 4/2008 Kim
2008/0148619 A1 6/2008 Rogers et al.
2008/0205037 A1 8/2008 Griffin
2008/0253110 A1 10/2008 Wu
2009/0013580 A1 1/2009 Houde-Walter
2009/0183416 A1 7/2009 Danielson
2009/0190339 A1 7/2009 Galli et al.
2009/0190341 A1 7/2009 Galli et al.
2009/0293335 A1 12/2009 Danielson
2009/0293855 A1 12/2009 Danielson et al.
2009/0307956 A1 * 12/2009 Barret ..... F41G 1/38 42/125
2010/0020536 A1 1/2010 Sharrah et al.
2010/0043271 A1 2/2010 Williams et al.
2010/0097789 A1 4/2010 Sharrah et al.
2010/0176741 A1 7/2010 Sharrah et al.
2010/0229449 A1 9/2010 Matthews et al.
2010/0229450 A1 9/2010 Becker et al.
2010/0254135 A1 10/2010 Bayat et al.
2010/0263256 A1 10/2010 Spinelli
2011/0047850 A1 3/2011 Rievley et al.
2011/0058362 A1 3/2011 Sun et al.
2011/0061283 A1 3/2011 Cavallo et al.
2011/0261559 A1 10/2011 Couture et al.
2011/0290968 A1 12/2011 Maughan et al.
2012/0055061 A1 3/2012 Hartley et al.
2012/0055062 A1 3/2012 Mironichev et al.
2012/0096755 A1 4/2012 Griffin
2012/0124885 A1 5/2012 Caulk
2012/0144718 A1 6/2012 Danielson et al.
2012/0167436 A1 7/2012 Westra
2012/0168589 A1 * 7/2012 Riley ..... F41G 11/003 248/315
2012/0198745 A1 8/2012 Riley et al.
2012/0216440 A1 8/2012 Riley et al.
2012/0227304 A1 * 9/2012 Engelhardt ..... F41C 27/00 42/90
2013/0000176 A1 * 1/2013 Goertzen ..... F41G 11/003 42/90
2013/0133238 A1 5/2013 Quetschke et al.
2013/0148367 A1 * 6/2013 Sharrah ..... F16B 7/00 362/396
2013/0185982 A1 7/2013 Hilbourne et al.
2014/0018508 A1 1/2014 Masubuchi et al.
2014/0092588 A1 4/2014 Toman et al.
2014/0196349 A1 7/2014 Rogers et al.
2014/0252187 A1 9/2014 Petrovic
2014/0305021 A1 10/2014 Prieto
2015/0124436 A1 5/2015 Galli et al.
2015/0143734 A1 5/2015 Ley
2015/0159847 A1 6/2015 Galli et al.
2015/0241169 A1 8/2015 Cheng et al.
2015/0241174 A1 8/2015 Silvennoinen
2015/0267999 A1 9/2015 Hovsepian
2015/0276347 A1 10/2015 Sharrah et al.
2015/0276352 A1 10/2015 Chang et al.
2015/0300386 A1 10/2015 Fong et al.
2016/0003460 A1 1/2016 Li et al.
2016/0025120 A1 1/2016 Swan et al.
2016/0146572 A1 5/2016 Ley
2016/0161220 A1 6/2016 Moore et al.
2016/0195366 A1 7/2016 Kowalczyk et al.
2016/0209168 A1 7/2016 Sharrah et al.
2016/0209174 A1 7/2016 Hartley et al.
2016/0349013 A1 12/2016 Ley
2016/0377385 A1 * 12/2016 Culp ..... F41G 11/003 42/126
2017/0138701 A1 5/2017 Kowalczyk, Jr. et al.
2017/0167817 A1 6/2017 Hayes
2017/0219314 A1 8/2017 McMakin

(56) References Cited

U.S. PATENT DOCUMENTS

| | | | | |
|---|---|---|---|---|
| 2017/0248389 | A1 | 8/2017 | DiCarlo et al. | |
| 2018/0023926 | A1 | 1/2018 | Jayaprakash | |
| 2018/0031352 | A1 | 2/2018 | Zeisler et al. | |
| 2018/0038580 | A1 | 2/2018 | Galli et al. | |
| 2018/0283670 | A1 | 10/2018 | Galli et al. | |
| 2019/0154243 | A1* | 5/2019 | Worman | F21V 19/0035 |
| 2019/0316882 | A1 | 10/2019 | Galli et al. | |
| 2021/0333068 | A1* | 10/2021 | Lindsay | F41G 11/003 |
| 2021/0356231 | A1* | 11/2021 | Tayon | F41G 1/35 |

OTHER PUBLICATIONS

M3 Tactical Illuminator Light Rail Adapter For Dovetails, GG&G, archived Jan. 13, 2004, accessed Jun. 21, 2017, 3 pages.

* cited by examiner

WEAPON ACCESSORY MOUNT

CROSS-REFERENCE TO RELATED APPLICATION

This application claims priority to U.S. Provisional Application No. 63/014,027, filed Apr. 22, 2020, the entirety of which is hereby incorporated by reference.

FIELD

The present disclosure generally relates to weapon accessories and more particularly to weapon accessory mounts.

BACKGROUND

Weapon (e.g., firearm) accessories use various types of mounting systems for mounting the accessories on weapons. For example, some rifles include a handguard or other structure having one or more accessory rails thereon, and some handguns include a rail under the barrel extending forward of the trigger guard. There are different types of rails with different configurations. Firearm accessories have different types of mounts configured to interface with the different types of rails to mount the accessories on each rail.

In general, accessory weapon rails will typically have an elongate body with one or more accessory slots defined by the elongate body. The elongate body typically has a dovetail shape to facilitate mounting and securing of an accessory to the rail. The accessory slots facilitate the mounting and/or positioning of accessories along the weapon rail. One type of weapon rail (e.g., a first weapon rail or first type of weapon rail) is shown in FIG. 1. The weapon rail 1 of FIG. 1 is commonly referred to as a Picatinny rail and has accessory slots 2 (e.g., a first accessory slot). The accessory slots 2 are generally uniformly spaced along the rail 1 and have a width W1 (e.g., a first width). Typically, the first width W1 is about 0.206-0.214 inches (about 5.23-5.43 mm). Another type of weapon rail (e.g., a second weapon rail or second type of weapon rail) is shown in FIG. 2. As is readily apparent, the weapon rail 3 of FIG. 2 has a different configuration than the rail 1 of FIG. 1. The weapon rail 3 of FIG. 2 is commonly referred to as a Weaver rail and has accessory slots 4 (e.g., a second accessory slot). The accessory slots 4 of the rail 3 of FIG. 2 have a different configuration than the accessory slots 2 of the rail 1 of FIG. 1. The accessory slots 4 of the rail 3 of FIG. 3 are non-uniformly spaced along the rail and have a width W2 (e.g., a second width), different from the first width W1. The second width W2 is smaller than that first width W1. Typically, the second width W2 is about 0.148 inches (about 3.75 mm).

Weapon accessories for weapon rails 1, 3 will typically have a feature that is inserted into the slot 2, 4 to prevent the accessory from sliding along the rail. However, as different types of rails 1, 3 have different configurations of slots 2, 4, the feature of a firearm accessory configured to be inserted into the slot of one type of rail cannot be used with other types of rails. The feature will either be too large (e.g., wide) to fit into the slot 2, 4, or too narrow thereby allowing a small amount of movement within the slot.

SUMMARY

In one aspect, a weapon accessory mount assembly mountable on a first weapon rail and a second weapon rail, the first weapon rail having a first slot and the second weapon rail having a second slot, the first and second slots having at least one different dimension, comprises a rail mount defining a rail channel sized and shaped to receive the first and second weapon rails to mount the rail mount to one of the first or second weapon rails. A rail slot key is configured to be inserted into the first slot of the first weapon rail and the second slot of the second weapon rail to inhibit longitudinal movement of the weapon accessory mount assembly along the first or second weapon rail when the weapon accessory mount assembly is mounted on the respective first or second weapon rail. The rail slot key has a first key portion sized and shaped to be inserted into the first slot and a second key portion sized and shaped to be inserted into the second slot. A fastener is configured to releasably secure the rail slot key to the rail mount in a first configuration and a second configuration. In the first configuration, the first key portion is arranged to be inserted into the first slot of the first weapon rail. In the second configuration, the second key portion is arranged to be inserted into the second slot of the second weapon rail.

In another aspect, a weapon accessory mount assembly mountable on a first weapon rail and a second weapon rail, the first weapon rail having a first slot and the second weapon rail having a second slot, the first and second slots having at least one different dimension, comprises a rail mount. The rail mount defines a rail channel sized and shaped to receive the first and second weapon rails to mount the rail mount to one of the first or second weapon rails. A rail slot key is configured to be inserted into the first slot of the first weapon rail and the second slot of the second weapon rail to inhibit longitudinal movement of the weapon accessory mount assembly along the first or second weapon rail when the weapon accessory mount assembly is mounted on the respective first or second weapon rail. The rail slot key has a first key portion sized and shaped to be inserted into the first slot and a second key portion sized and shaped to be inserted into the second slot. A threaded fastener is configured to threadably engage the rail slot key to releasably secure the rail slot key to the rail mount in a first configuration and a second configuration. In the first configuration, the first key portion is arranged to be inserted into the first slot of the first weapon rail. In the second configuration, the second key portion is arranged to be inserted into the second slot of the second weapon rail.

In another aspect, a weapon accessory mount assembly mountable on a first weapon rail and a second weapon rail, the first weapon rail having a first slot and the second weapon rail having a second slot, the first and second slots having at least one different dimension, comprises a rail mount. The rail mount defines a rail channel sized and shaped to receive the first and second weapon rails to mount the rail mount to one of the first or second weapon rails. The rail mount defines a key recess. A rail slot key is configured to be inserted into the first slot of the first weapon rail and the second slot of the second weapon rail to inhibit longitudinal movement of the rail mount along the first or second weapon rail when the rail mount is mounted on the respective first or second weapon rail. The rail slot key has a first key portion sized and shaped to be inserted into the first slot and a second key portion sized and shaped to be inserted into the second slot. The rail slot key is receivable in the key recess in a first configuration and a second configuration. In the first configuration, the first key portion is oriented to be inserted into the first slot of the first weapon rail. In the second configuration, the second key portion is oriented to be inserted into the second slot of the second weapon rail. The rail slot key has a longitudinal axis that extends generally parallel to the respective first or second slot when the weapon accessory mount assembly is mounted on the respective first or second weapon rail. The rail slot key is movable into the key recess in a direction transverse to the longitudinal axis to position the rail slot key in the first or second configuration.

Other objects and features of the present disclosure will be in part apparent and in part pointed out herein.

BRIEF DESCRIPTION OF THE DRAWINGS

Corresponding reference characters indicate corresponding parts throughout the drawings.

DETAILED DESCRIPTION

Figure 1:
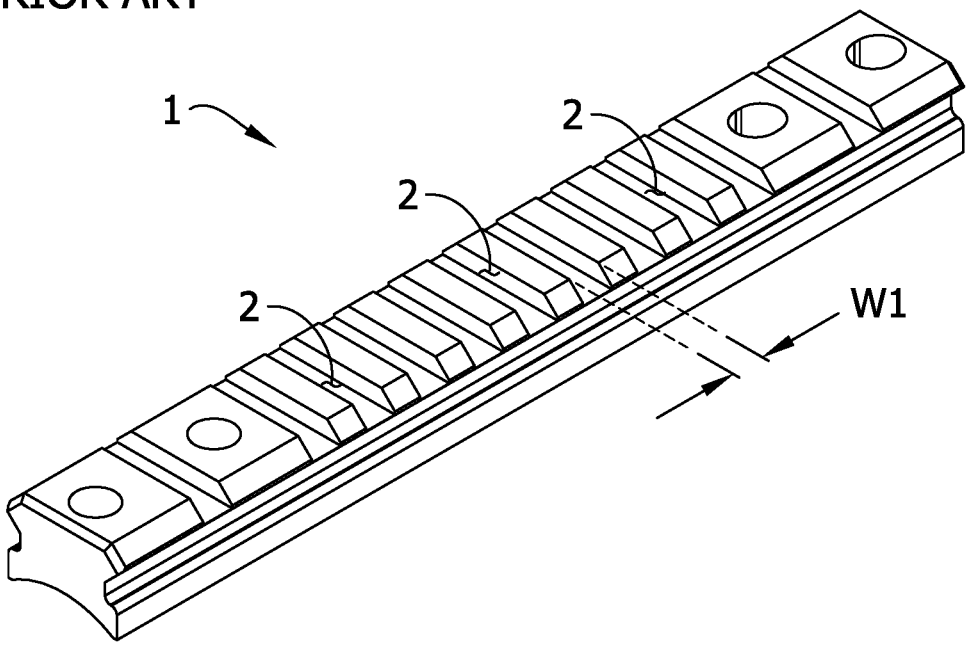
FIG. 1 PRIOR ART
FIG. 1 is a perspective of a conventional Picatinny rail.
Figure 2:
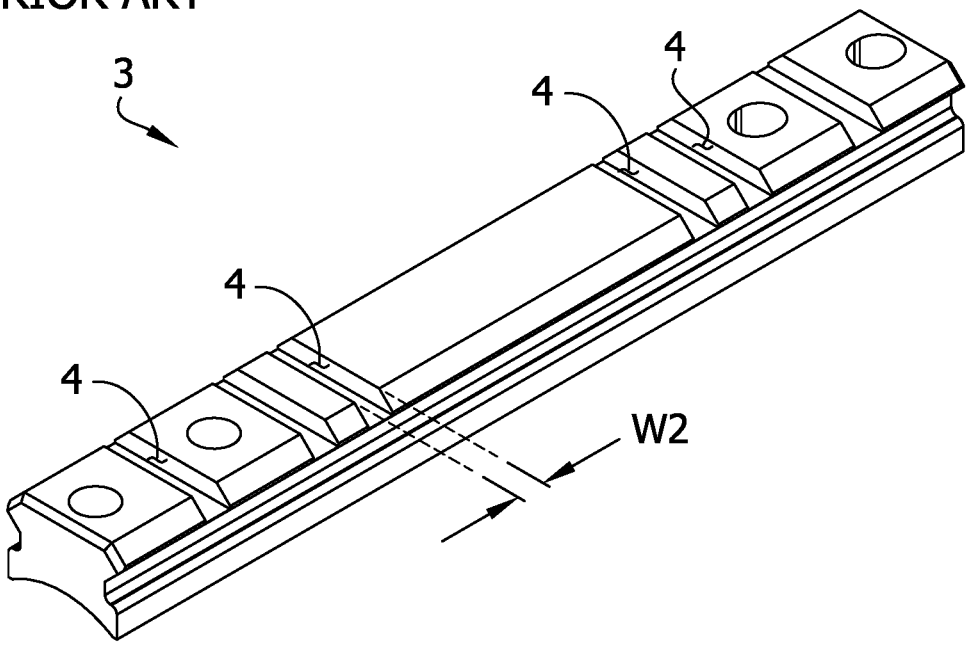
FIG. 2 PRIOR ART
FIG. 2 is a perspective of a conventional Weaver rail.
Figure 3:
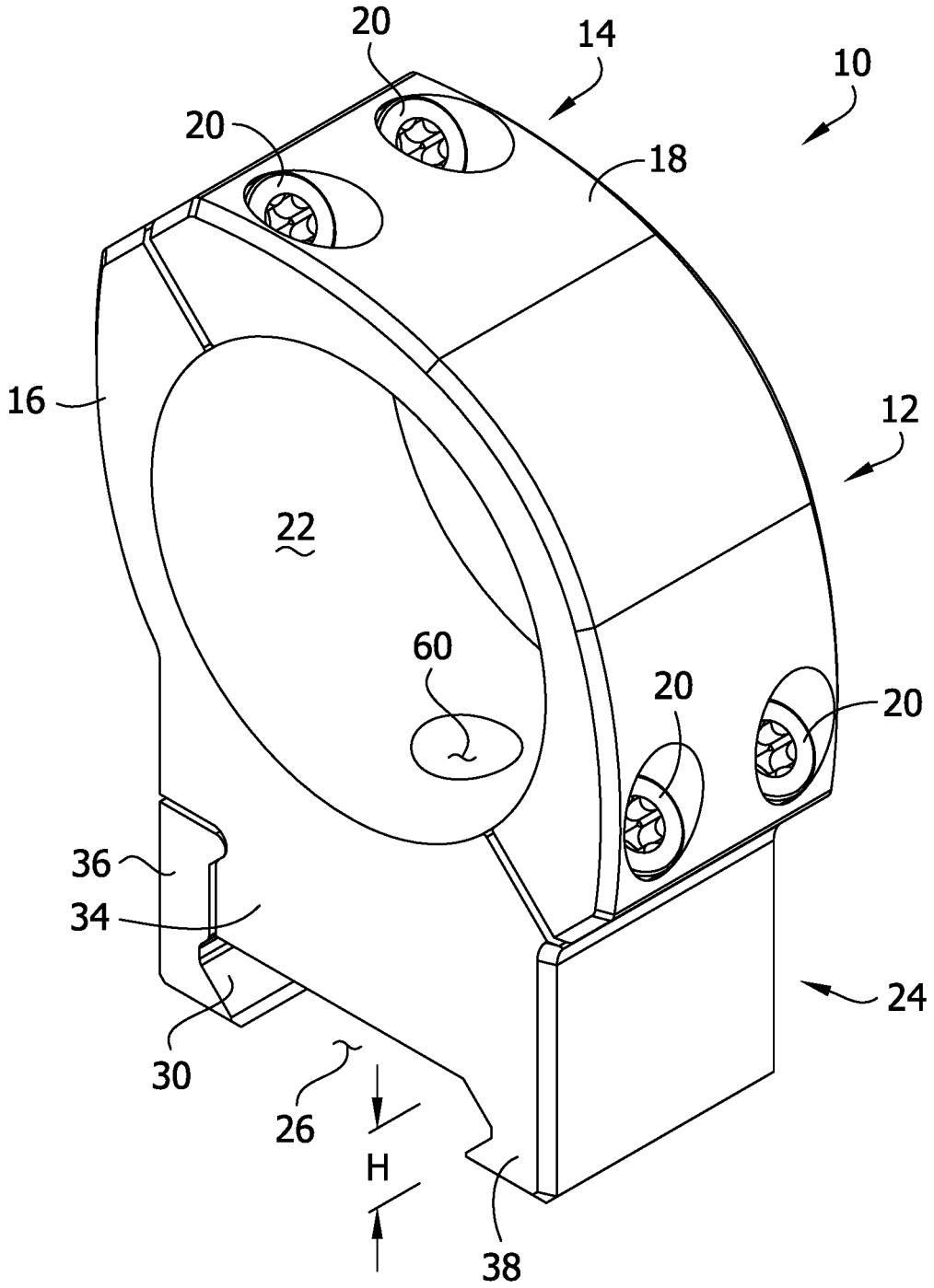
FIG. 3 is a perspective of a weapon accessory mount assembly according to one embodiment of the present disclosure.
Figure 4:
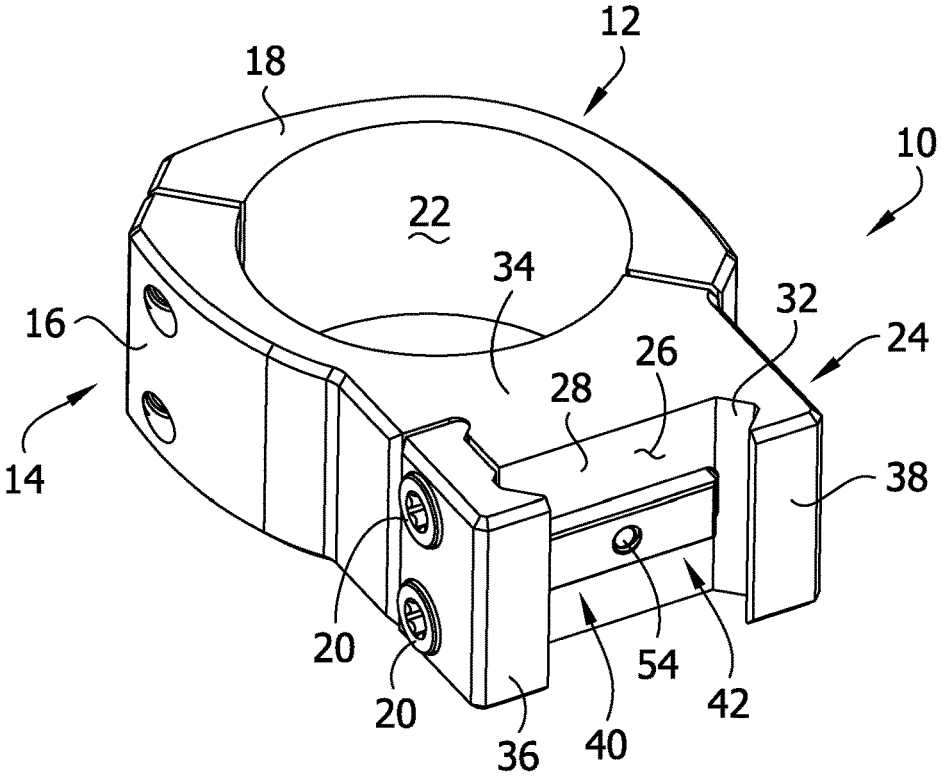
FIG. 4 is a bottom perspective of the weapon accessory mount assembly with a rail slot key in a first configuration.
Figure 5:
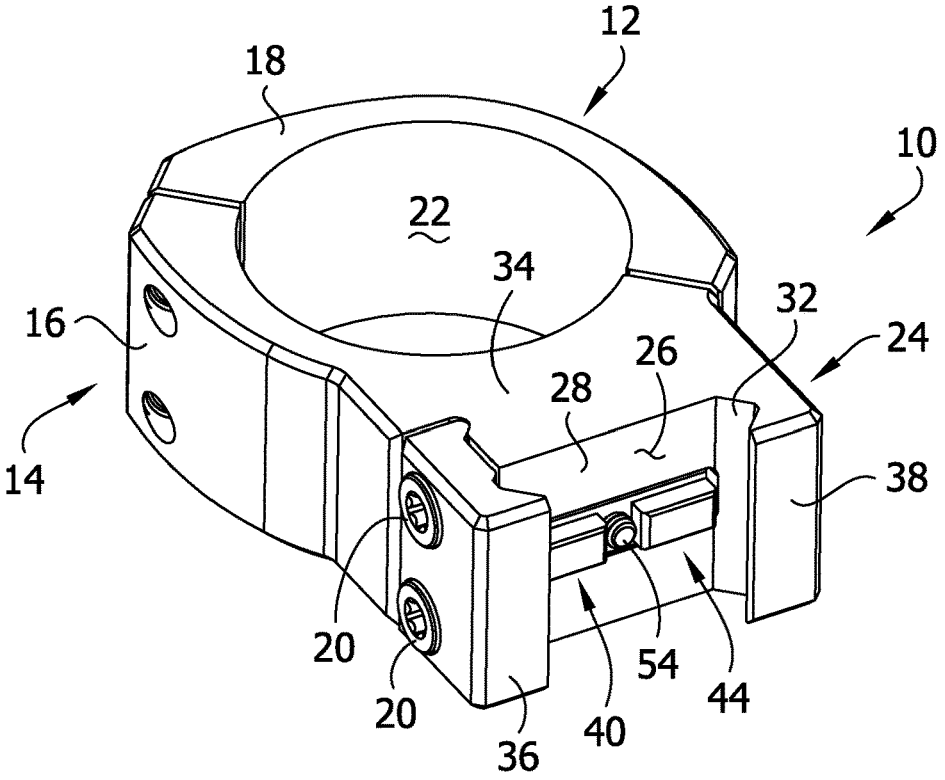
FIG. 5 is a bottom perspective of the weapon accessory mount assembly with the rail slot key in a second configuration.

Referring to FIGS. 3-5, one embodiment of a weapon (e.g., firearm) accessory mount assembly (e.g., a weapon accessory mount) of the present disclosure is generally indicated by reference numeral 10. The weapon accessory mount assembly 10 is mountable on one or more weapon rails, such as the first weapon rail 1 of FIG. 1 and the second weapon rail 3 of FIG. 2. The rails 1, 3 each include slots, such as the first slot 2 and the second slot 4 respectively, having at least one different dimension, such as the widths W1, W2. The weapon accessory mount assembly 10 will be described herein as being mountable to the first weapon rail 1 of FIG. 1 and the second weapon rail 3 of FIG. 2, but it is understood the weapon accessory mount assembly can be mountable on other types of weapon rails without departing from the scope of the present disclosure. The rails 1, 3 (or other types of rails on which the assembly 10 is mountable) can be an integral part of the weapon (not shown) or separate from and mounted on the weapon. The rail 1, 3 can be mounted at generally any position on the weapon, such as in front of a trigger guard, above a barrel of the weapon, below a barrel of the weapon, etc.

The weapon accessory mount assembly 10 is configured to mount a weapon (e.g., firearm) accessory (not shown), such as a sight, scope, light, laser, light plus laser combination, etc. to the rail 1, 3. It will be understood that the weapon accessory mount assembly 10 can be used to mount generally any type of weapon accessory to the rail 1, 3 without departing from the scope of the present disclosure. In the illustrated embodiment, the weapon accessory mount assembly 10 includes an accessory mount 12 configured to attach or be coupled to a weapon accessory. In the illustrated embodiment, the accessory mount 12 comprises a scope ring 14 configured to couple to a scope (not shown). The scope ring 14 includes a first ring portion 16 and a second ring portion 18 releasably secured together with one or more fasteners 20 (e.g., bolts). The first and second ring portions 16, 18 define a scope aperture 22 sized and shaped to receive and secure the scope therein to couple the scope to the scope ring 14. Other configurations of the accessory mount for attaching to other types and/or sizes of weapon accessories are within the scope of the present disclosure.

The weapon accessory mount assembly 10 includes a rail mount 24 configured to couple to the first and second rails 1, 3. The rail mount 24 defines a rail channel 26 sized and shaped to receive the first and second rails 1, 3 to mount the rail mount to one of the first or second rails. In other words, the rail channel 26 can receive the first rail 1 or the second rail 3 one at a time to mount the weapon accessory mount assembly 10 to either the first rail or the second rail. The rail channel 26 has a cross-sectional shape that generally corresponds to the identical or similar dovetail cross-sectional shapes of the first and second rails 1, 3. The rail channel 26 has a base 28, and opposite first and second sides 30, 32 defined by the rail mount 24. The rail channel 26 has an open mouth opposite the base 28 and a height H (FIG. 3) extending between the base and the open mouth. In the illustrated embodiment, the rail mount 24 includes a mounting base 34, a first rail guide 36, and a second rail guide 38. The mounting base 34 defines the base 28 of the rail channel 26. The first rail guide 36 defines the first side 30 of the rail channel 26 and the second rail guide 38 defines the second side 32 of the rail channel. The first rail guide 36 is configured to engage one (e.g., a first) side of the respective first or second rail 1, 3 to mount the rail mount 24 to the first or second rail. Likewise, the second rail guide 38 is configured to engage the opposite side (e.g., a second side) of the respective first or second rail 1, 3 to mount the rail mount 24 to the first or second rail. In the illustrated embodiment, the rail guides 36, 38 are configured to clamp the rail 1, 3 by tightening the fasteners 20 and may be referred to broadly as jaws. Each first and second rail guide 38 includes a groove that defines at least a portion of the respective first and second sides 30, 32 of the rail channel 26. Each groove is sized and shaped to receive a side edge portion (e.g., side edge) of the rail 1, 3 (e.g., dovetail shape) to secure the rail mount 24 to the rail. The first rail guide 36 is releasably secured to the mounting base 34. The weapon accessory mount assembly 10 includes one or more (e.g., two) fasteners 20 (e.g., bolts) that releasably secure the first rail guide 36 to the mounting base 34. Detaching the first rail guide 36 from the mounting base 34 permits the rail mount 24 to be mounted to the rail 1, 3. In the illustrated embodiment, the second rail guide 36 is fixed to (e.g., integrally formed with) the mounting base 34. Other configurations of the rail mount 24 are within the scope of the present disclosure.

The rail mount 24 of the weapon accessory mount assembly 10 is coupled (e.g., fixed) to the accessory mount 12. In the illustrated embodiment, the rail mount 24 is integrally formed with the accessory mount 12. Specifically, the mounting base 34 is integrally formed with the first ring portion 16. In other embodiments, the rail mount and the accessory mount 12 may be separate components joined together such as with fasteners, by welding or any other suitable means. In one embodiment, the weapon accessory mount assembly 10 may not include the accessory mount. In this embodiment, the weapon accessory mount assembly (e.g., the rail mount) may be part of the weapon accessory.

Figure 6:
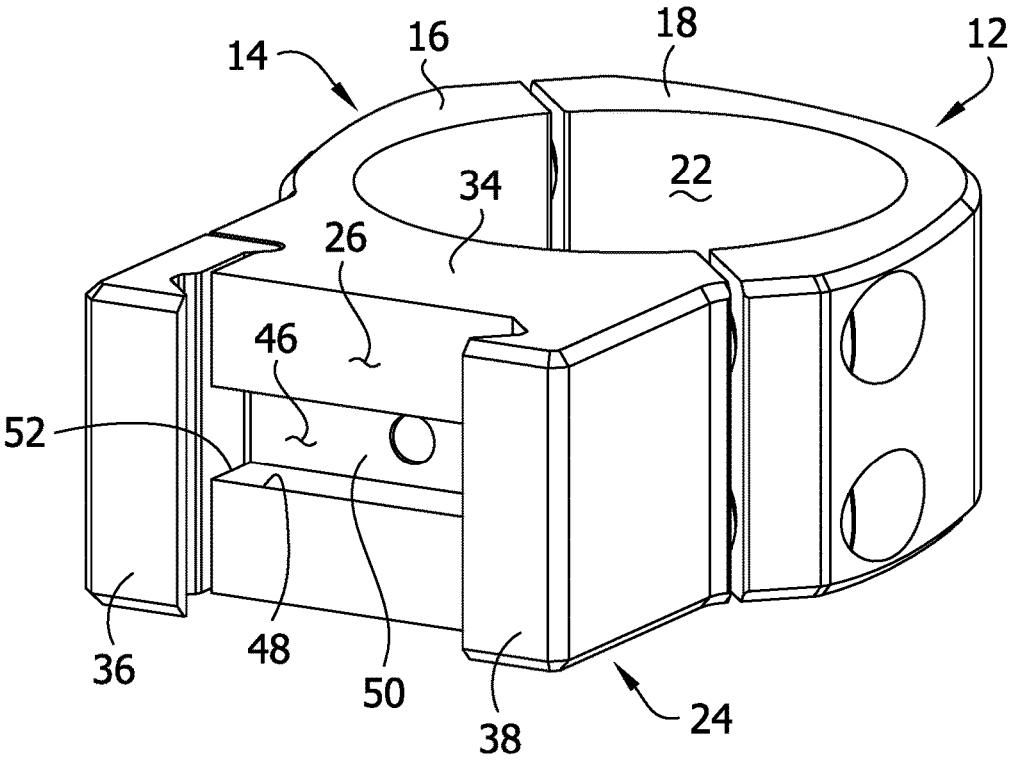
FIG. 6 is a bottom perspective of the weapon accessory mount assembly with the rail slot key removed to reveal interior details.
Figure 7:
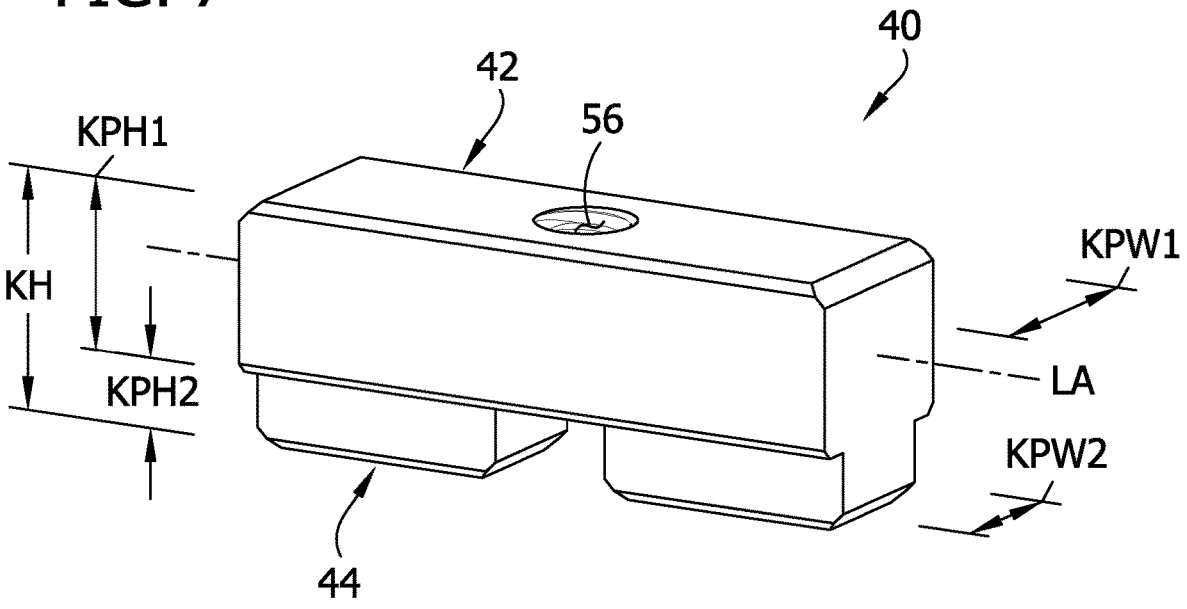
FIG. 7 is a perspective of the rail slot key.

Referring to FIGS. 4-7, the weapon accessory mount assembly 10 includes a rail slot key 40. The rail slot key 40 is configured to be inserted into one of the slots 2, 4 of the rail 1, 3 to secure the weapon accessory mount assembly to the rail. Specifically, the rail slot key is configured to be inserted into the first slot 2 of the first rail 1 and the second slot 4 of the second rail 3 to inhibit movement (e.g., longitudinal movement) of the weapon accessory mount assembly 10 along the first or second rail when the weapon accessory mount assembly is mounted on either the first rail or the second rail. The rail slot key 40 has a first key portion 42 sized and shaped to be inserted into the first slot 2 of the first rail 1 and a second key portion 44 sized and shaped to be inserted into the second slot 4 of the second rail 3. As mentioned above, slots of different rails have different dimensions, such as the slots 2, 4 of the rails 1, 3 of FIGS. 1 and 2 having different widths W1, W2. The first and second key portions 42, 44 are each configured to be inserted into a particular slot of a rail and are each sized and shaped to fit that particular slot's unique dimensions (e.g., width). Accordingly, the first and second key portions 42, 44 of the rail slot key 40 enable the weapon accessory mount assembly 10 to be mounted on different types of rails, such as the rails 1, 3 of FIGS. 1 and 2. In the illustrated embodiment, the first key portion 42 is disposed on one side (e.g., an upper side as shown in FIG. 7) of the rail slot key 40 and the second key portion is disposed on an opposite side (e.g., a lower side as shown in FIG. 7) of the rail slot key. Other arrangements of the first and second key portions on the rail slot key can be used without departing from the scope of the present disclosure. The rail slot key 40 has a longitudinal axis LA. The longitudinal axis LA extends generally parallel to the slot (e.g., length of the slot) of a rail, such as the first and second slots 2, 4 of the respective first and second rails 1, 3 of FIGS. 1 and 2, when the weapon accessory mount assembly 10 is mounted on the rail.

In the illustrated embodiment, the first and second key portions 42, 44 have different widths to correspond to the different widths W1, W2 of the first and second slots 2, 4 of the respective first and second rails 1, 3. It is understood the first and second key portions can have other differences (size, shape, dimensions such a length) to correspond to other types of slots. The key portions can be configured to match the configuration of a slot the key portion is to be inserted into. In the illustrated embodiment, the first key portion 42 has a first key portion width KPW1 (FIG. 7) corresponding to (e.g., matching or being slightly less than) the first width W1 of the first slot 2 of the first rail 1. Likewise, the second key portion 44 has a second key portion width KPW2 (FIG. 7) corresponding to (e.g., matching or being slightly less than) the second width W2 of the second slot 4 of the second rail 3. Accordingly, the first and second key portions widths KPW1, KPW2 are different from each other. Specifically, the first key portion width KPW1 is larger than the second key portion width KPW2. As shown in FIG. 7, the first key portion 42 has a first key portion height KPH1 and the second key portion has a second key portion height KPH2. The rail slot key has an overall key height KH, which in the illustrated embodiment is the combination of the first key portion height KPH1 and the second key portion height KPH2.

The rail slot key 40 is configured to be secured to the rail mount in a first configuration or orientation (FIG. 4) and a second configuration or orientation (FIG. 5). In the first configuration, the first key portion 42 is arranged or oriented to be inserted into a slot of a rail (FIG. 8), such as the first slot 2 of the first rail 1 of FIG. 1. As shown in FIG. 4, in the first configuration, the first key portion 42 is disposed (e.g., at least partially disposed) in the rail channel 26. In the second configuration, the second key portion 44 is arranged or oriented to be inserted into a slot of a rail (FIG. 9), such as the second slot 4 of the second rail 3 of FIG. 2. As shown in FIG. 5, in the second configuration, the second key portion 44 is disposed (e.g., at least partially disposed) in the rail channel 26. As the first and second key portions 42, 44 are disposed on opposite sides of the rail slot key 40, the rail slot key is generally turned over or rotated about 180 degrees by a user to move the rail slot key between the first and second configurations.

Referring to FIG. 6, the rail mount 24 (e.g., the mounting base 34) defines a key channel or recess 46. The key channel 46 is sized and shaped to receive the rail slot key 40. Specifically, the rail slot key 40 is receivable in the key channel 46 in the first configuration and the second configuration. The rail slot key 40 is disposed in the key channel 46 when the rail slot key is in the first configuration and when the rail slot key is in the second configuration. The key channel 46 extends generally perpendicular (e.g., laterally or transversely relative) to the rail channel 26. The key channel 46 has an open mouth 48 opposite a base 50. The key channel 46 extends inward into the mounting base 34 from the open mouth 48. The key channel 56 has a key channel height KCH (FIG. 9) extending between the open mouth 48 and base 50. The key height KH of the rail slot key 40 is greater than the key channel height KCH. Accordingly, when the rail slot key 40 is attached to the rail mount 24, the rail slot key 40 extends through the mouth 48 of the key channel 46 into the rail channel 26. Desirably, the key channel height KCH is greater than at least one of the first key portion height KPH1 and the second key portion height KPH2. This ensures that the rail slot key 40 (e.g., the first and second key portions 42, 44) will be able to be inserted into a slot in a rail, such as the slots 2, 4 of the rails 1, 3 in FIGS. 1 and 2, regardless of whether the rail slot key is secured to the rail mount 24 in the first configuration or the second configuration. In the illustrated embodiment, first key portion height KPH1 generally corresponds to the key channel height KCH and the second key portion height KPH2 is about half of the key channel height. Other configurations are within the scope of the present disclosure.

The rail slot key 40 is movable into and out of the key channel 46 through the open mouth 48. Generally, the rail slot key 40 is movable into the key channel 46 in a direction transverse (e.g., generally perpendicular) to the longitudinal axis LA of the rail slot key to position the rail slot key in the first or second configuration. Specifically, the rail slot key 40 can be moved into and out of the key channel 46 through the mouth 48 of the key channel in a direction that is generally parallel to the key channel height KCH. The key channel 46 also includes an open end 52 sized and shaped to permit the rail slot key 40 to slide into and out of the key channel through the open end. In the illustrated embodiment, the first rail guide 36 blocks the open end 52 of the key channel 46 when the first rail guide is secured to the mounting base 34 of the rail mount 24. The rail slot key 40 can be moved between the first and second configurations regardless of whether or not the first rail guide 36 is attached to the mounting base 34.

Figure 8:
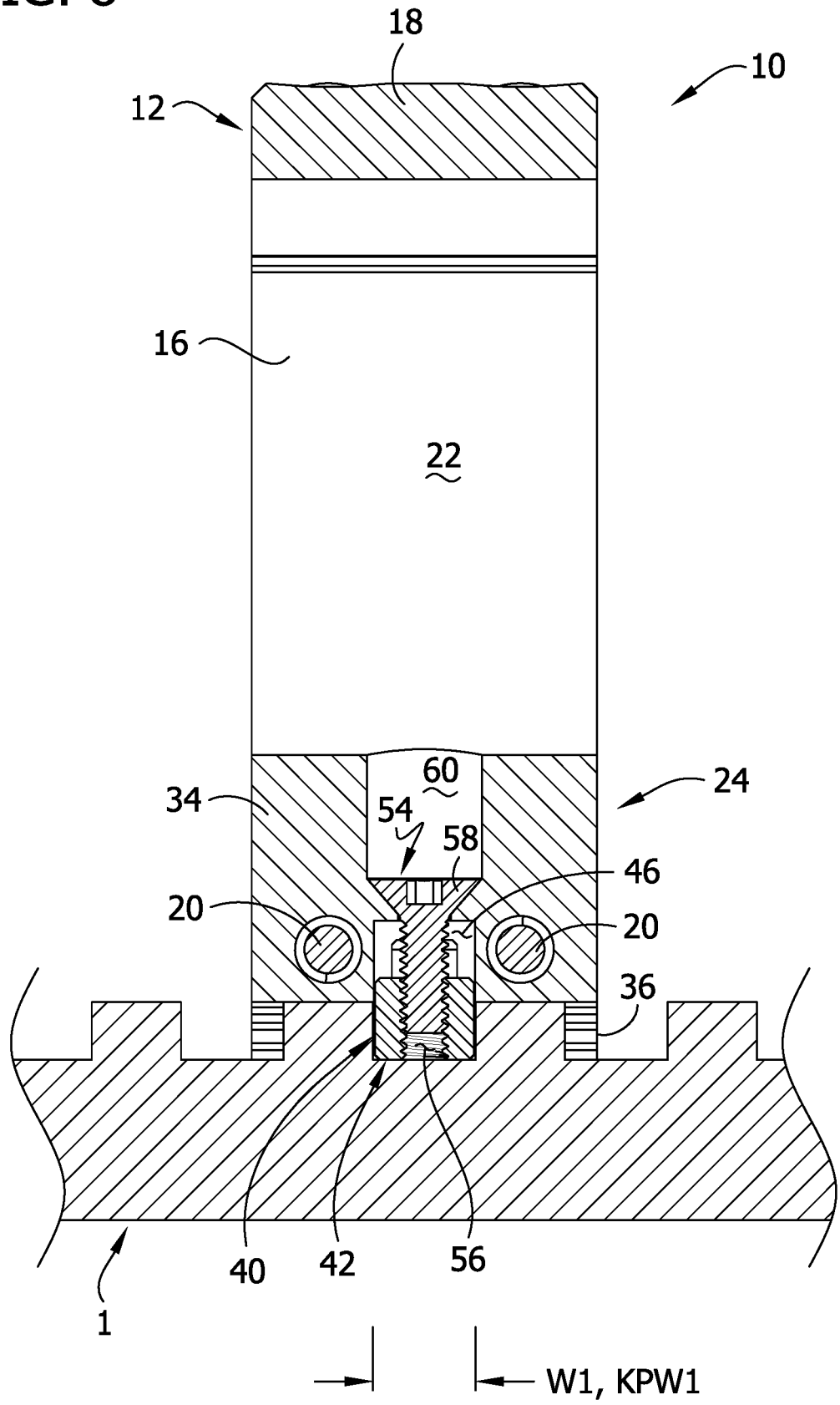
FIG. 8 is a longitudinal cross-section of the weapon accessory mount assembly mounted on the Picatinny rail of FIG. 1, with the rail slot key in the first configuration.
Figure 9:
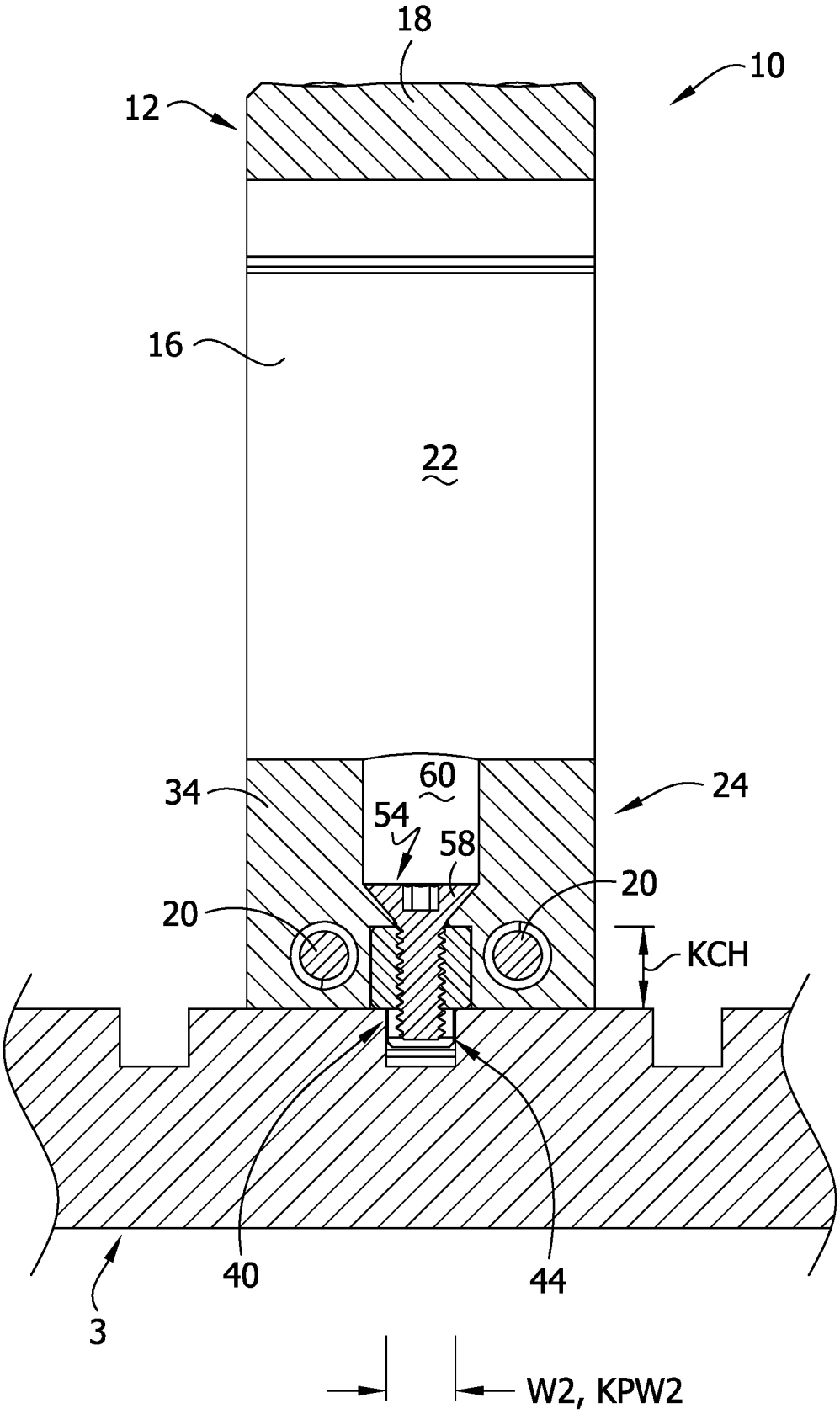
FIG. 9 is a longitudinal cross-section of the weapon accessory mount assembly mounted on the Weaver rail of FIG. 2, with the rail slot key in the second configuration.
Figure 10:
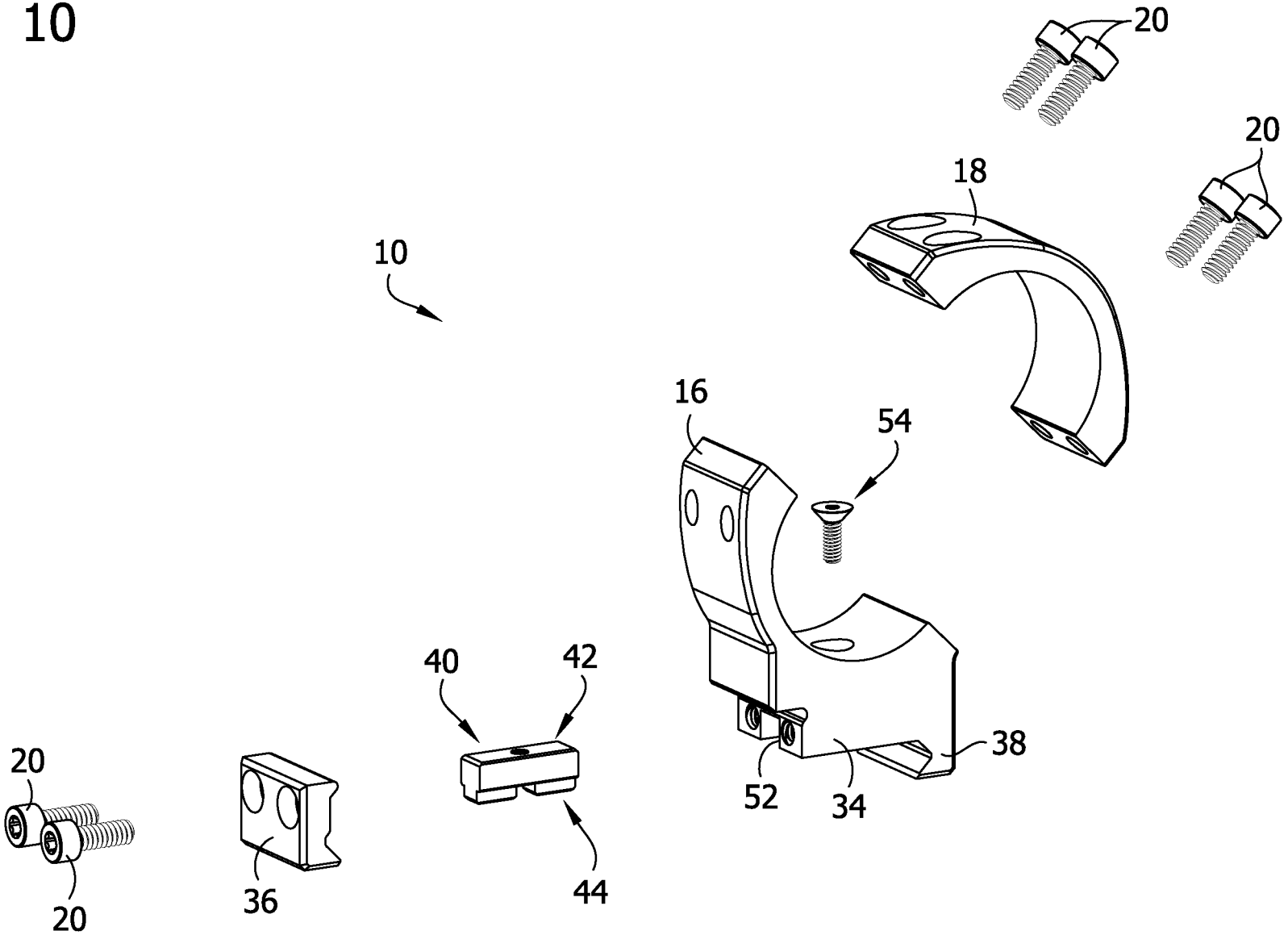
FIG. 10 is an exploded view of the weapon accessory mount assembly.

Referring to FIGS. 4, 5, and 8-10, the weapon accessory mount assembly 10 includes a fastener 54 for releasably securing the rail slot key 40 to the rail mount 24. The fastener 54 secures the rail slot key 40 to the rail mount 24 in the first configuration and in the second configuration. In the illustrated embodiment, the fastener 54 is a threaded fastener configured to threadably engage the rail slot key 40 to releasably secure the rail slot key to the rail mount 24. The rail slot key 40 includes a threaded hole 56 (FIG. 7) that receives the threaded shaft of the threaded fastener 54. As shown in FIGS. 8 and 9, the fastener 54 extends through the base 28 of the rail channel 26 when securing the rail slot key 40 to the rail mount 24. Furthermore, the fastener 54 extends generally through the mounting base 34 to secure the rail slot key 40 to the mounting base. Accordingly, the fastener 54 (e.g., the shaft) extends generally parallel to the key channel height KCH when securing the rail slot key 40 to the rail mount 24. Likewise, the fastener 54 extends generally parallel to the rail channel height H when securing the rail slot key 40 to the rail mount 24. The mounting base 34 of the rail mount 24 defines a fastener head receiving space 60 sized and shaped to receive a head 58 of the fastener 54 when the fastener 54 secures the rail slot key 40 to the rail mount. In the illustrated embodiment, the fastener head receiving space 60 has an open end in communication with the scope aperture 22. The fastener head receiving space 60 extends from the open end toward the key channel 46. When the fastener 54 is installed, the head of the fastener abuts a shoulder defined by the base 34 to locate the fastener with respect to the base and secure the key 40. A user can access the head 48 of the fastener 54 through the open end of the fastener receiving space 60 to secure or release the rail slot key 40 to the rail mount 24 by rotating the fastener.

In a method of using the weapon accessory mount assembly 10, the user selects a weapon to which they would like to mount the weapon accessory mount. The user then configures the key 40 to have the appropriate portion 42, 44 oriented for interfacing with the type of slot on the rail of the weapon. The key 40 may have the appropriate portion 42, 44 already oriented to be received in the slot of the rail. Otherwise, the fastener 54 can be removed, the key 40 flipped over, and the fastener reinstalled. The weapon accessory mount is then mounted on the rail using the jaws 36, 38 and fasteners 20.

When introducing elements of the present invention or the preferred embodiments(s) thereof, the articles "a", "an", "the" and "said" are intended to mean that there are one or more of the elements. The terms "comprising", "including" and "having" are intended to be inclusive and mean that there may be additional elements other than the listed elements.

It will be apparent that modifications and variations are possible without departing from the scope defined in the appended claims.

As various changes could be made in the above constructions and methods without departing from the scope of the disclosure, it is intended that all matter contained in the above description and shown in the accompanying drawings shall be interpreted as illustrative and not in a limiting sense.

What is claimed is:

1. A weapon accessory mount assembly mountable on a first weapon rail and a second weapon rail, the first weapon rail having a first slot and the second weapon rail having a second slot, the first and second slots having at least one different dimension, the weapon accessory mount assembly comprising:

a rail mount defining a rail channel sized and shaped to receive the first and second weapon rails to mount the rail mount to one of the first or second weapon rails;

a rail slot key configured to be inserted into the first slot of the first weapon rail and the second slot of the second weapon rail to inhibit longitudinal movement of the weapon accessory mount assembly along the first or second weapon rail when the weapon accessory mount assembly is mounted on the respective first or second weapon rail, the rail slot key including a first key portion and a second key portion coupled to the first key portion, the first key portion sized and shaped to be inserted into the first slot and the second key portion sized and shaped to be inserted into the second slot; and a fastener being selectively moveable with respect to the rail channel and configured to directly engage and releasably secure the rail slot key to the rail mount in a first configuration and a second configuration, wherein in the first configuration the first key portion is coupled to the second key portion and is arranged to be inserted into the first slot of the first weapon rail and wherein in the second configuration the second key portion is coupled to the first key portion and is arranged to be inserted into the second slot of the second weapon rail.

2. The weapon accessory mount of claim 1, wherein in the first configuration the first key portion is oriented to be disposed in the rail channel and wherein in the second configuration the second key portion is oriented to be disposed in the rail channel, the rail slot key having a position in the second configuration which is inverted from a position of the rail slot key in the first configuration.

3. The weapon accessory mount of claim 2, wherein the first key portion has a first key portion width corresponding to a first width of the first slot and the second key portion has a second key portion width corresponding to a second width, different from the first width, of the second slot, the first and second key portion widths being different from each other.

4. The weapon accessory mount of claim 3, wherein the rail mount defines a key recess, the rail slot key being disposed in the key recess when the rail slot key is in the first and second configurations.

5. The weapon accessory mount of claim 4, wherein the key recess has a key recess height, the first key portion has a first key portion height and the second key portion has a second key portion height, the recess height being greater than at least one of first key portion height and the second key portion height.

6. The weapon accessory mount of claim 5, wherein the first key portion is disposed on one side of the rail slot key and the second key portion is disposed on an opposite side of the rail slot key.

7. The weapon accessory mount of claim 5, wherein the fastener is configured to extend generally parallel to the key recess height when the fastener is installed to secure the rail slot key to the rail mount.

8. The weapon accessory mount of claim 1, wherein the fastener comprises a threaded fastener, the threaded fastener threadably engaging the rail slot key to releasably secure the rail slot key to the rail mount.

9. The weapon accessory mount of claim 8, wherein the threaded fastener is configured to extend generally parallel to a height of the rail channel when the fastener is securing the rail slot key to the rail mount.

10. The weapon accessory mount of claim 9, wherein the rail mount defines a base and opposite first and second sides of the rail channel, the threaded fastener extending in the base of the rail channel when securing the rail slot key to the rail mount.

11. The weapon accessory mount of claim 10, wherein the threaded fastener includes a head, and wherein the rail mount includes a mounting base defining the base of the rail channel, the mounting base defining a fastener head receiving space sized and shaped to receive the head of the threaded fastener when securing the rail slot key to the rail mount.

12. The weapon accessory mount of claim 1, wherein the accessory mount comprises a scope ring configured to couple to a scope.

13. The weapon accessory mount of claim 1, in combination with at least one of the first weapon rail or the second weapon rail.

14. A weapon accessory mount assembly mountable on a first weapon rail and a second weapon rail, the first weapon rail having a first slot and the second weapon rail having a second slot, the first and second slots having at least one different dimension, the weapon accessory mount assembly comprising:

a rail mount defining a rail channel sized and shaped to receive the first and second weapon rails to mount the rail mount to one of the first or second weapon rails;

a rail slot key configured to be inserted into the first slot of the first weapon rail and the second slot of the second weapon rail to inhibit longitudinal movement of the weapon accessory mount assembly along the first or second weapon rail when the weapon accessory mount assembly is mounted on the respective first or second weapon rail, the rail slot key including a first key portion and a second key portion coupled to the first key portion, the first key portion sized and shaped to be inserted into the first slot and the second key portion sized and shaped to be inserted into the second slot; and a threaded fastener configured to threadably engage the rail slot key to releasably secure the rail slot key to the rail mount in a first configuration and a second configuration, wherein in the first configuration the first key portion is coupled to the second key portion and is arranged to be inserted into the first slot of the first weapon rail and wherein in the second configuration the second key portion is coupled to the first key portion and is arranged to be inserted into the second slot of the second weapon rail.

15. The weapon accessory mount of claim 14, wherein the first key portion has a first key portion width corresponding to a first width of the first slot and the second key portion has a second key portion width corresponding to a second width, different from the first width, of the second slot, the first and second key portion widths being different from each other.

16. The weapon accessory mount of claim 14, wherein the rail mount defines a key recess extending generally perpendicular to the rail channel, the rail slot key being disposed in the key channel when the key channel is in the first and second configurations.

17. The weapon accessory mount of claim 16, wherein the key recess has an open end sized and shaped to permit the rail slot key to slide into and out of the key channel through the open end.

18. The weapon accessory mount of claim 17, wherein the rail mount includes a mounting base and a first rail guide releasably secured to the mounting base, the first rail guide configured to engage one side of the respective first or second weapon rail to mount the rail mount to the first or second weapon rail, the first rail guide blocking the open end of the key channel when the first rail guide is secured to the mounting base of the rail mount.

19. The weapon accessory mount of claim 18, wherein the rail mount includes a second rail guide configured to engage an opposite side of the respective first or second weapon rail to mount the rail mount to the first or second weapon rail.

20. A weapon accessory mount assembly mountable on a first weapon rail and a second weapon rail, the first weapon rail having a first slot and the second weapon rail having a second slot, the first and second slots having at least one different dimension, the weapon accessory mount assembly comprising:

a rail mount defining a rail channel sized and shaped to receive the first and second weapon rails to mount the rail mount to one of the first or second weapon rails, the rail mount defining a key recess;

a rail slot key configured to be inserted into the first slot of the first weapon rail and the second slot of the second weapon rail to inhibit longitudinal movement of the rail mount along the first or second weapon rail when the rail mount is mounted on the respective first or second weapon rail, the rail slot key having a first key portion sized and shaped to be inserted into the first slot and a second key portion sized and shaped to be inserted into the second slot, the rail slot key being receivable in the key recess in a first configuration and a second configuration, wherein in the first configuration the first key portion is oriented to be inserted into the first slot of the first weapon rail, and wherein in the second configuration the second key portion is oriented to be inserted into the second slot of the second weapon rail, the rail slot key having a longitudinal axis that extends generally parallel to the respective first or second slot when the weapon accessory mount assembly is mounted on the respective first or second weapon rail, the rail slot key being movable into the key recess in a direction transverse to the longitudinal axis to position the rail slot key in the first or second configuration, the rail slot key having a position in the second configuration which is inverted from a position of the rail slot key in the first configuration.

21. The weapon accessory mount of claim 1, wherein the rail slot key defines an opening configured to receive the fastener.

22. The weapon accessory mount of claim 21, wherein the fastener is threaded and the opening is threaded to form a threaded connection with the fastener.

23. The weapon accessory mount of claim 1, wherein the first key portion and the second key portion are located on opposing sides of the rail slot key.

24. The weapon accessory mount of claim 21, wherein the first key portion has a first key portion width corresponding to a first width of the first slot and the second key portion has a second key portion width corresponding to a second width, different from the first width, of the second slot, the first and second key portion widths being different from each other.

25. The weapon accessory mount of claim 24, wherein the key recess has a key recess height, the first key portion has a first key portion height and the second key portion has a second key portion height, the recess height being greater than at least one of first key portion height and the second key portion height.

26. The weapon accessory mount of claim 25, wherein the first key portion is disposed on one side of the rail slot key and the second key portion is disposed on an opposite side of the rail slot key.

27. The weapon accessory mount of claim 26, wherein the rail mount includes a mounting base and a first rail guide releasably secured to the mounting base, the first rail guide configured to engage one side of the respective first or second weapon rail to mount the rail mount to the first or second weapon rail, the first rail guide blocking the open end of the key channel when the first rail guide is secured to the mounting base of the rail mount.

28. The weapon accessory mount of claim 27, wherein the rail mount includes a second rail guide configured to engage an opposite side of the respective first or second weapon rail to mount the rail mount to the first or second weapon rail.

29. A weapon accessory mount assembly mountable on a first weapon rail and a second weapon rail, the first weapon rail having a first slot and the second weapon rail having a second slot, the first slot having a first width, and the second slot having a second width different than the first width, the weapon accessory mount assembly comprising:

a rail mount defining a rail channel sized and shaped to receive the first and second weapon rails to mount the rail mount to one of the first or second weapon rails, the rail mount defining a key recess;

a rail slot key configured to be inserted into the first slot of the first weapon rail and the second slot of the second weapon rail to inhibit longitudinal movement of the rail mount along the first or second weapon rail when the rail mount is mounted on the respective first or second weapon rail, the rail slot key including a first key portion sized and shaped to be inserted into the first slot and a second key portion sized and shaped to be inserted into the second slot, the first key portion having a first key portion width for reception into the first slot, the second key portion having a second key portion width for reception into the second slot, the first key portion width being larger than the second key portion width, the rail slot key being receivable in the key recess in a first configuration and a second configuration, wherein in the first configuration the first key portion is oriented to be inserted into the first slot of the first weapon rail and the first key portion width of the first key portion is received in the key recess, and wherein in the second configuration the second key portion is oriented to be inserted into the second slot of the second weapon rail and the first key portion width of the first key portion is received in the key recess.

30. The weapon accessory mount of claim 29, wherein the key recess includes opposing side walls, wherein the first key portion is configured to engage the opposing side walls of the key recess in both the first and second configurations to inhibit longitudinal movement of the rail mount along the first or second weapon rail when the rail mount is mounted on the respective first or second weapon rail.

31. The weapon accessory mount of claim 30, wherein the first key portion width is a largest overall width of the rail slot key.

32. The weapon accessory mount of claim 29, wherein the key recess has a key recess height, the first key portion has a first key portion height and the second key portion has a second key portion height, the recess height being greater than the second key portion height.

33. The weapon accessory mount of claim 29, further comprising a fastener being selectively moveable with respect to the rail channel and configured to releasably secure the rail slot key to the rail mount in the first configuration.

34. The weapon accessory mount of claim 33, wherein the fastener is configured to releasably secure the rail slot key to the rail mount in the second configuration.

35. The weapon accessory mount of claim 33, wherein the fastener comprises a threaded fastener, the threaded fastener threadably engaging the rail slot key to releasably secure the rail slot key to the rail mount.

36. The weapon accessory mount of claim 29, the rail slot key having a longitudinal axis that extends generally parallel to the respective first or second slot when the weapon accessory mount assembly is mounted on the respective first or second weapon rail, the rail slot key being movable into the key recess in a direction transverse to the longitudinal axis to position the rail slot key in the first or second configuration.

* * * * *